United States Patent [19]

Martin

[11] Patent Number: 4,957,056

[45] Date of Patent: Sep. 18, 1990

[54] RETRACTABLE ARRANGEMENT FOR FISHING BOAT CONSOLE COMPONENTS

[75] Inventor: Robert L. Martin, Springfield, Mo.

[73] Assignee: Tracker Marine Corporation, Springfield, Mo.

[21] Appl. No.: 351,397

[22] Filed: May 15, 1989

[51] Int. Cl.[5] ..... B63B 17/00

[52] U.S. Cl. ..... 114/343; 114/361

[58] Field of Search ..... 114/343, 361; 296/70, 296/73, 84.1, 92

[56] References Cited

U.S. PATENT DOCUMENTS

| | | | |
|---|---|---|---|
| 3,134,112 | 5/1964 | Hage | 114/361 |
| 3,290,706 | 12/1966 | Hale | 114/361 |
| 3,320,698 | 5/1967 | Hummel | 114/361 |
| 3,913,701 | 10/1975 | Williams | 296/70 |
| 4,549,625 | 10/1985 | Tindall | 296/70 |
| 4,706,810 | 11/1987 | Petrilli | 296/70 |

*Primary Examiner*—Sherman D. Basinger
*Assistant Examiner*—Stephen P. Avila

[57] ABSTRACT

A power actuated mechanism for raising and lowering a console mounted windscreen and/or electronics panel on a fishing boat. An electric actuator has its base end pivoted to the console and its rod end extending downwardly to a pivot connection with the lower end of a rigid bracket. The bracket is secured at its upper end to the electronics box so that retraction of the actuator raises the box and windscreen about a hinge axis while extension of the actuator effects lowering of the box-windscreen.

20 Claims, 1 Drawing Sheet

RETRACTABLE ARRANGEMENT FOR FISHING BOAT CONSOLE COMPONENTS

BACKGROUND AND SUMMARY OF THE INVENTION

This invention relates generally to fishing boats and more particularly to a fishing boat having a control console which is equipped with a windshield screen, electronics box or other components that may be raised and lowered by a uniquely arranged power actuator.

Many fishing boats are equipped with steering and control consoles which are typically located near the center of the boat. When the boat is driven from place to place at a relatively high speed, the driver is normally stationed at the steering wheel immediately behind the console. It has proven desirable to provide the console with a windscreen so that the driver is sheltered from the wind, water and other elements. One problem with the windscreen is that in order to make it tall enough to effectively protect the driver, the windscreen can be a significant obstruction to fishing activities. Conversely, if the windscreen is provided with a low profile so that it is out of the way and does not interfere with fishing activities, it is too low to adequately protect the driver when the boat is traveling at relatively high speed.

It is also proven to be convenient for the normal gauges of the control console to be supplemented by a separate electronic panel that includes depth finders, meters, graphs, special switches and other electronic accessories, along with a glove box compartment that is suitable to hold various fishing aids and other items. The separate electronics panel may be conveniently located directly above the control console where it is both visible and easily accessible. However, problems are encountered in protecting the panel against the elements and maintaining items stored in the glove box compartment in a secure condition.

The present invention is directed to an extension and retraction mechanism that can be used to raise and lower either a windscreen or an electronics panel or both. In accordance with the invention, a box structure that may include an electronics panel and may carry the windscreen on it is mounted for up and down hinged movement between raised and lowered positions. In the fully raised position, the windscreen is elevated to provide effective protection from the wind and the electronics panel is exposed immediately above the console panel at a convenient location. In the lowered position, the windscreen presents a low profile and the electronics panel is recessed within the console where it is both secure and sheltered from the elements.

A power driven actuator and a special linkage arrangement raise and lower the box and/or windshield. The actuator is preferably an electrical actuator having its base end pivoted to the console and its rod end pivoted to a rigid bracket. The opposite or upper end of the bracket is connected with the box so that the box is raised when the actuator retracts and is lowered when the actuator extends. The construction and arrangement of the actuator linkage makes effective use of leverage and results in the box being pulled upwardly rather than pushed so that the stresses and mechanical problems are minimized.

DETAILED DESCRIPTION OF THE INVENTION

Figure 3:
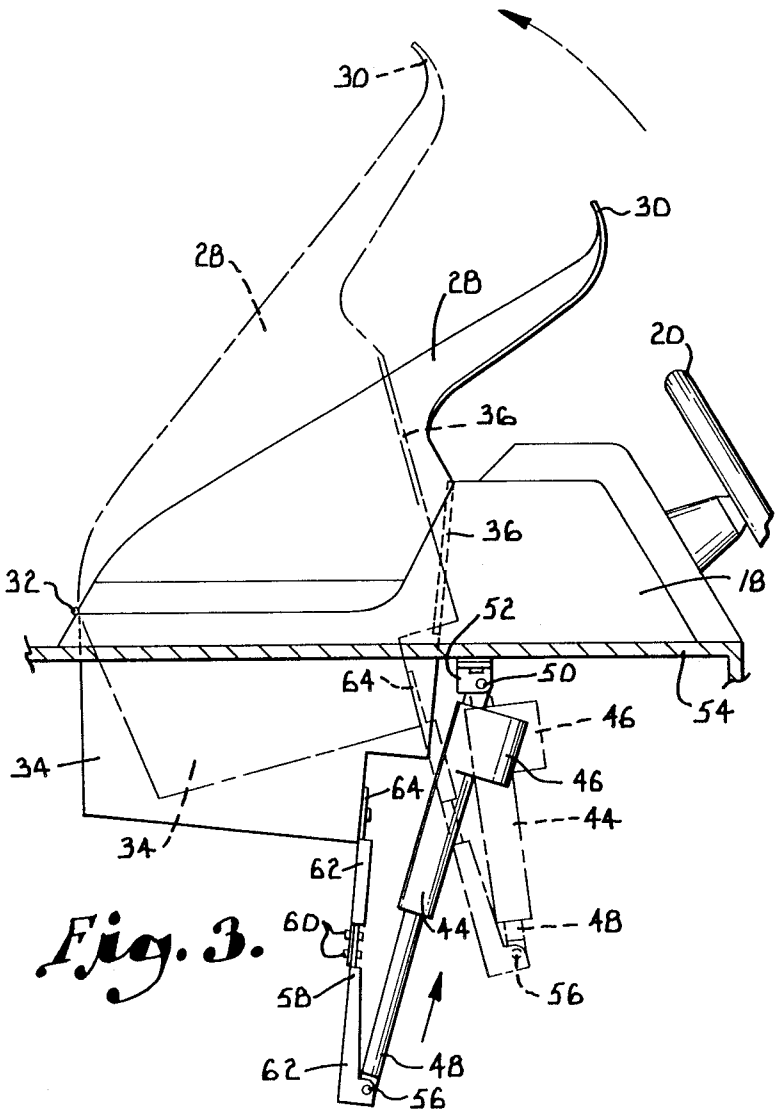
Figure 1:
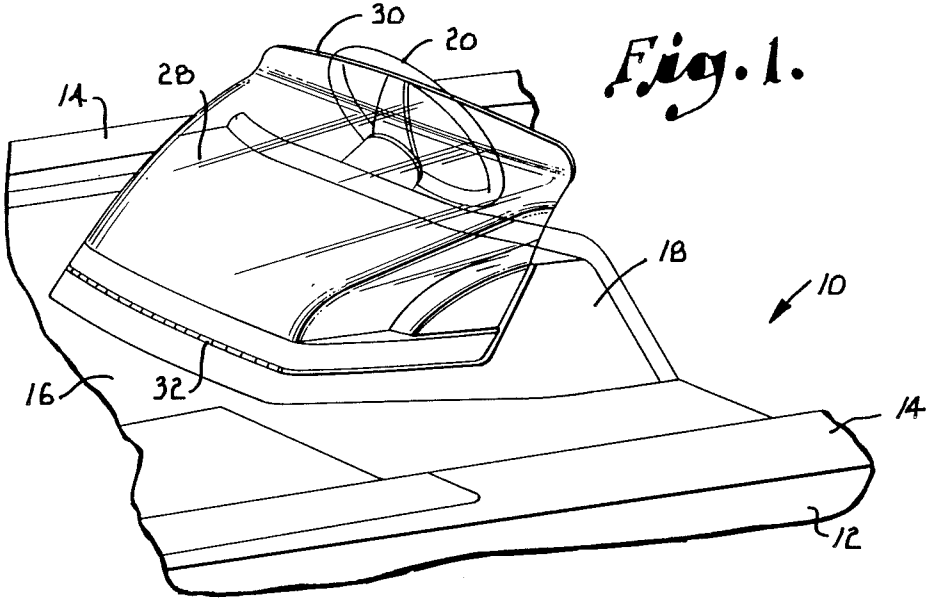
Figure 2:
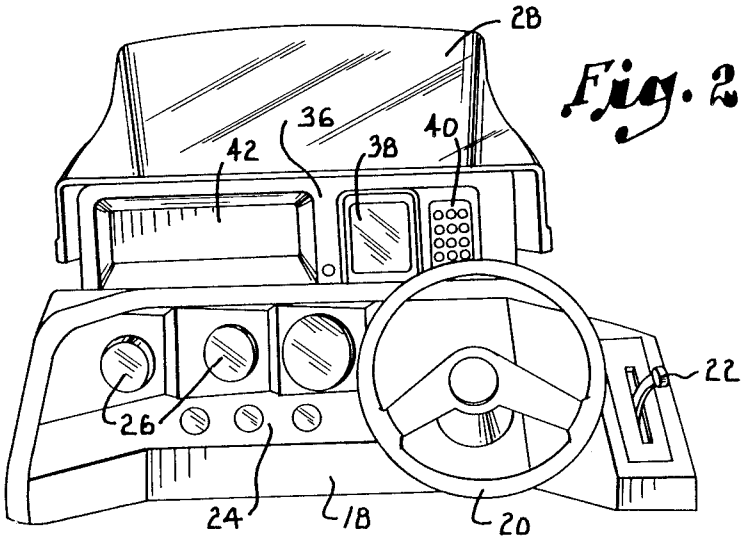

In the accompanying drawings which form a part of the specification and are to be read in conjunction there with and in which like reference numerals are used to indicate like parts in the various views:

FIG. 1 is a fragmentary perspective view of a fishing boat which is equipped with a control console having a hinged windscreen thereon in accordance with the present invention;

FIG. 2 is a fragmentary rear elevational view of a fishing boat control console showing an electronics panel and windscreen in their raised position on top of the console; and FIG. 3 is a fragmentary sectional view taken on a vertical plane showing the actuator mechanism which raises and lowers the windscreen and attached components, with the solid lines illustrating the lowered position of the windscreen and the phantom lines illustrating the raised position.

Referring now to the drawings in more detail, numeral 10 generally designates a fishing boat which may be constructed in a conventional manner. The boat 10 has a hull 12, gunwales 14 on its opposite sides and a fishing deck 16 in the bow area. A steering and control console 18 is located near the center of the boat 10 immediately in front of a suitable driver's seat (not shown). As best shown in FIG. 2, the console 18 is equipped with a steering wheel 20, a throttle 22, and a control panel 24 having various gauges 26 thereon.

In accordance with the present invention, a windscreen 28 is mounted on top of the control console 18. The windscreen 28 may be constructed of a suitable transparent plastic which may be tinted if desired. The windscreen 28 has opposite side portions which wrap partially around the sides of the console. The upper edge of the windscreen is provided with an upturned lip 30 which serves to direct air upwardly in order to deflect it away from the driver of the boat or other persons stationed behind the control console 18.

The windscreen 28 is mounted on top the console 18 by a piano type hinge 32 which provides a horizontal axis about which the windscreen 30 may be pivoted between the raised position shown in phantom lines in FIG. 3 and the lowered position shown in broken lines in FIG. 3.

The windscreen 28 may be connected with a box structure 34 which is typically an electronics box that houses various electronic components useful in fishing activity. As best shown in FIG. 2, the box 34 has a face 36 which takes the form of an electronics panel having a display screen 38 and an LED indicator panel 40 located in front of the steering wheel. The face panel 36 may also be provided with a storage compartment 42 which serves as a glove box compartment for receiving and storing fishing accessories and other items.

The windscreen 28 and the attached box 34 are raised and lowered about the axis of hinge 32 by an electric actuator 44 which is shown in FIG. 3. The actuator 44 is driven by a reversible electric motor 46 which receives electrical power from the electrical system of the boat 10 and which is controlled by a suitable switch (not shown). Through a gearing arrangement (not shown) the motor 46 extends and retracts a rod 48 which extends from the main cylinder body of the actuator 44. When the motor 46 is operated in one directional mode, the rod 48 is extended by means of a conventional screw drive system (not shown) so that the distance between the opposite ends of the actuator is increased. Conversely, operation of the motor 46 in the opposite directional mode causes the rod 48 to retract to reduce the distance between the opposite ends of the actuator. The actuator 44 is a conventional actuator that is commercially available, and it should be noted that other types of actuators can be used in the present invention.

The top or base end of the actuator 44 is pivoted at 50 to a mounting bracket 52 which is in turn screwed or otherwise mounted to the underside of the console 18. The bottom of the console 18 may be provided with a horizontal panel 54 to which the bracket 52 is mounted. The pivot pin 50 provides a horizontal pivot axis about which the base end of actuator 44 may pivot.

The lower rod or end of the actuator 44 is pivoted at 56 to the lower end of a rigid bracket 58. The bracket 58 may have a two-part construction, with upper and lower sections bolted together at 60 near the center of the bracket. The two sections of bracket 58 may take the form of flat plates having flanges 62 on their edges for added strength and rigidity. The upper end of bracket 58 is provided with an integral mounting plate 64 which is bolted or otherwise secured to the backside of box 34 near its bottom at a location considerably offset from the hinge 32. The pivot pin 56 provides a horizontal axis about which bracket 58 and rod 48 may pivot relative to one another.

In use, the mechanism of the present invention allows the windscreen 28 and the electronics box 34 to be raised and lowered as desired. When normal fishing activity is being carried out, the actuator 44 may be maintained in the fully extended position shown in solid lines in FIG. 3 to completely lower the windscreen 28 and the electronics box 34. In its lowered position, the windscreen 28 presents a low profile so that it does not unduly obstruct or otherwise interfere with fishing activity on the boat. In addition, the box 34 is retracted generally into the console 18, with the face panel 36 recessed into the console at an inaccessible position. Thus, the electronic components are sheltered from the elements and the glove box compartment 42 and its contents are secured against unauthorized persons.

When the boat is operated at a relatively high speed, it may be desirable to raise the windscreen 28 to the phantom line position shown in FIG. 3. With the windscreen raised, its elevated profile provides enhanced deflection of wind, water and the like and is particularly effective in shielding an operator stationed at the control console 18. The air is deflected upwardly by the windscreen, and the curved lip 30 causes it to be diverted upwardly and over the head of the operator of the boat. Thus, it is desirable for the windscreen to be in its fully raised position when the boat is traveling at high speed, as between fishing spots.

When the box 34 is in its raised position, the face panel 36 is fully exposed at a location immediately above the control console 18, as shown in FIG. 2. Then, the screen 38 is readily visible and the switch pad 40 is readily accessible. Additionally, the glove box compartment 42 and its contents are conveniently accessible from the operators station. It is noted that the tinted windscreen 28 shields panel 36 and provides enhanced visibility of the panel and particularly the LED indicator lights on the LED panel 40.

In order to raise the windscreen 28 and the box 34, the motor 36 is activated in a directional mode to retract the rod 48 of the actuator 44. When the rod has been fully retracted as shown in phantom lines in FIG. 3, the windscreen and box are fully raised. Conversely, operating motor 36 in the opposite directional mode extends rod 48 and thus lowers the windscreen and box.

It is noted that the arrangement of the actuator 44 and the linkage which connects it with the conscle structure and with the box and windscreen effects a pulling action in raising the box 34. The rod 48 is pulled upwardly in order to raise the box, rather than pushing the box upwardly as would be the case if the base end of the actuator were mounted on the floor of the boat or some other low location. As a consequence of the pulling action that is provided, the stress on the actuator and its linkage is reduced significantly, and mechanical problems are minimized. It is also noted that the connection of the linkage to the box 34 is a considerable distance away from the hinge 32. Therefore, advantage is taken of mechanical leverage in that a relatively long lever arm is provided between the hinge 32 and the mounting bracket 64.

It should be understood that the mechanism of the present invention can be used to raise and lower only the windscreen 28 by itself, only the electronics box 34 by itself or both the windscreen and electronic box together as described herein. In addition, the face panel 36 of the electronics box may be only an electronics panel or it may include only the glove box 42 or other storage compartment. In any event, the arrangement of the actuator and the actuator linkage provides the various advantages that have been noted.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a fishing boat having a control console, the improvement comprising:

a windscreen;

means for mounting said windscreen on the console for pivotal movement about a hinge axis between a raised position and a lowered position;

an extensible and retractable power actuator having opposite upper and lower ends and being extensible to increase the distance between said ends;

means for pivotally connecting the upper end of said actuator with said console;

a rigid bracket having upper and lower ends, said upper end of the bracket being connected with the windscreen; and means for pivotally connecting the lower end of said bracket with the lower end of said actuator in a manner to effect movement of the windscreen toward the raised position upon retraction of the actuator and toward the lowered position upon extension of the actuator.

2. The improvement of claim 1, wherein:

said actuator includes an extensible and retractable rod which presents said lower end of the actuator; and said actuator has a base end which presents said upper end of the actuator.

3. The improvement of claim 2, wherein said actuator comprises an electric actuator.

4. The improvement of claim 1, including an electronic panel connected with said windscreen for movement therewith, said panel being exposed above the conscle in the raised position and being recessed into the console in the lowered position.

5. In a fishing boat having a control console, the improvement comprising:

a box structure having a face therein;

means for mounting said box structure on the console in a manner permitting the box structure to pivot about a substantially horizontal hinge axis between a raised position wherein said face is exposed above the console and a lowered position wherein said face is recessed into the console at an inaccessible location;

a power driven actuator having upper and lower ends, said actuator being extensible and retractable to respectively increase and decrease the distance between said ends;

means for pivotally connecting the upper end of said actuator with the console;

a rigid bracket having upper and lower ends, said upper end of the bracket being connected with said box structure at a location offset from said hinge axis; and means for pivotally coupling the lower end of said actuator with the lower end of said bracket in a manner to effect movement of the box structure toward the raised position upon retraction of the actuator and toward the lowered position upon extension of the actuator.

6. The improvement of claim 5, including an electronic panel on said face of the structure.

7. The improvement of claim 6, including a glove box compartment on said face of the box structure.

8. The improvement of claim 7, including a windscreen carried on said box structure for movement therewith between the raised and lowered positions.

9. The improvement of claim 6, including a windscreen carried on said box structure for movement therewith between the raised and lowered positions.

10. The improvement of claim 5, including a windscreen carried on said box structure for movement therewith between the raised and lowered positions.

11. The improvement of claim 5, including a glove box compartment on said face of the box structure.

12. The improvement of claim 11, including a windscreen carried on said box structure for movement therewith between the raised and lowered positions.

13. The improvement of claim 5, wherein:

said actuator includes an extensible and retractable rod which presents said lower end of the actuator; and said actuator has a base end which presents said upper end of the actuator.

14. The improvement of claim 13, wherein said actuator comprises an electric actuator.

15. The improvement of claim 5, wherein said actuator comprises an electric actuator.

16. In a fishing boat having a control console equipped with a steering wheel, the improvement comprising:

a box structure having a face thereon, said box structure carrying a windscreen;

means for mounting said box structure on the console in a manner to pivot thereon about a substantially horizontal hinge axis between raised and lowered positions, said face being exposed in the raised position and being recessed into the console in the lowered position;

a power operated actuator having an extensible and retractable rod;

means for pivotally connecting said actuator with the console; and a rigid bracket having an upper end connected with said box structure and a lower end pivotally coupled with said rod in a manner to effect movement of said box structure toward the raised position upon retraction of the actuator rod and toward the lowered position upon extension of the actuator rod.

17. The improvement of claim 16, wherein said actuator comprises an electric actuator.

18. The improvement of claim 16, including an electronic panel on said face of the box structure.

19. The improvement of claim 18, including a glove box compartment on said face of the box structure.

20. The improvement of claim 16, including a glove box compartment on said face of the box structure.

* * * * *